United States Patent [19]

Komoto et al.

[11] Patent Number: 4,765,878

[45] Date of Patent: Aug. 23, 1988

[54] PLATING CURRENT AUTOMATIC COMPENSATING APPARATUS

[75] Inventors: Haruo Komoto; Shigeharu Hamada; Yasuo Shiinoki, all of Hyogo; Katsumi Nagano, Fukuoka; Michio Sato; Hiroo Goshi, both of Aichi, all of Japan

[73] Assignees: Mitsubishi Denki Kabushiki Kaisha; Nippon Steel Corporation, both of Tokyo, Japan

[21] Appl. No.: 4,563

[22] Filed: Jan. 20, 1987

Related U.S. Application Data

[63] Continuation-in-part of Ser. No. 681,649, Dec. 14, 1984, abandoned.

[51] Int. Cl.[4] ..... C25D 17/00; C25D 21/12

[52] U.S. Cl. ..... 204/211; 204/228

[58] Field of Search ..... 204/211, 228

[56] References Cited

U.S. PATENT DOCUMENTS

| | | | |
|---|---|---|---|
| 2,744,230 | 5/1956 | Few et al. | 204/228 X |
| 3,061,534 | 10/1962 | Jasperson | 204/211 |
| 3,887,452 | 6/1975 | Mannaka et al. | 204/211 |
| 4,240,881 | 12/1980 | Stanya | 204/228 X |
| 4,497,695 | 2/1985 | Shinkai et al. | 204/228 X |

*Primary Examiner*—Donald R. Valentine

*Attorney, Agent, or Firm*—Bernard, Rothwell & Brown

[57] ABSTRACT

An apparatus for automatically maintaining plating current density within a predetermined range while controlling plating current to produce a desired plating thickness includes means for energizing only the number of plating cells required to maintain plating current density within the predetermined range. The total plating current required to produce the desired plating thickness is distributed among the energized plating cells. Decreases in the number of energized plating cells is made at speed values which are less by a hysteresis value than speeds at which the number of energized plating cells is increased to avoid instability due to normal speed reading variations.

2 Claims, 9 Drawing Sheets

PLATING CURRENT AUTOMATIC COMPENSATING APPARATUS

This application is a continuation-in-part of application Ser. No. 681,649, filed Dec. 14, 1984 now abandoned.

BACKGROUND OF THE INVENTION

1. Field of the Invention

The present invention relates to an apparatus for controlling the electroplating of a strip being passed sequentially through a plurality of plating cells.

2. Description of the Prior Art

Prior art apparatus for controlling electroplating of a continuous strip through a plurality of plating cells has included automatic control circuitry for controlling the total current applied to the plurality of cells as a function of a measured speed of the strip in order to maintain an even plating thickness on the strip when the line speed increases or decreases. A total current per unit speed criterion is initially set based upon one or more factors such as the desired plating thickness, electrode efficiency and the width of the strip. A desired total plating current value is calculated by multiplying the total current per unit speed criterion by the measured speed of the strip. The actual total plating current is controlled by comparing a measured total plating current value with the calculated desired total plating current value and controlling the plating current to maintain the measured value equal to the calculated value.

FIG. 1 is a block diagram of one such conventional plating current control apparatus. A strip 1 is moved in the direction indicated by the arrow successively through plating cells 3*a*, 3*b*, 3*c* and 3*d* by a conventional drive mechanism (not shown) for electroplating a desired thickness on the strip. Sensors, such as current sensing resistive shunts 4*a*, 4*b*, 4*c* and 4*d*, are connected in series with the plating current lines from respective thyristor control circuits 5*a*, 5*b*, 5*c* and 5*d* to the respective plating cells. Controllers 6*a*, 6*b*, 6*c* and 6*d* have first inputs connected to outputs of the respective sensors 4*a*, 4*b*, 4*c* and 4*d*, have second inputs connected to outputs oil respective distributors 7*a*, 7*b*, 7*c* and 7*d*, and have outputs operatively connected to the respective thyristor circuits 5*a*, 5*b*, 5*c* and 5*d*. The controllers are designed to operate the thyrister circuits so that the plating current to each cell is proportional to the input voltage from the corresponding distributor, i.e., the plating current to each cell is increased when the voltage from the corresponding sensor is less than the voltage from the corresponding distributor, and is decreased when the voltage from the corresponding sensor is greater than the voltage from the corresponding distributor. An adder 8 has inputs connected to the outputs of the respective sensors 4*a*, 4*b*, 4*c* and 4*d* and is designed to produce an output which is the sum of the voltages from the sensors. The output of adder 8 is connected to one input of an adder 10*a* which subtracts the sum of the sensor voltages from a voltage applied to a second input of the adder 10*a* by an arithmetic circuit 10. The output of adder 10*a* is connected to the input of a PI controller 9 which has an output connected to inputs of the distributors 7*a*, 7*b*, 7*c* and 7*d*. The PI controller is designed to produce an output voltage which is the integral of its input so that when the output of adder 8 is less than the output of arithmetic circuit 10, the output of PI controller 9 is increased, and when the output of adder 8 is greater than the output of arithmetic circuit 10, the output of PI controller 9 is decreased. The distributors 7*a*, 7*b*, 7*c* and 7*d* are conventional multiplier circuits set to divide the input voltage from PI controller 9 by n, where n is the number of plating cells. The arithmetic circuit 10 has inputs from a current criterion circuit 11 and a speed sensor 2 mechanically coupled to a wheel engaging the strip 1. The current criterion circuit 11 is designed to produce a set voltage representing total current per unit speed criterion, and the arithmetic circuit 10 is designed to produce the product, i.e., multiple, of the outputs from the current criterion circuit 11 and the line speed sensor 2 so that the output of the arithmetic circuit 10 is proportional to the total plating current required to plate a desired thickness on the strip 1 at the measured line speed.

In operation of the apparatus of FIG. 1, the voltage output of PI controller 9 increases and decreases in accordance with increases and decreases in the speed of the strip 1 through the plating cells 3*a*–3*d* so as to maintain the production of a uniform plating thickness on the strip 1 during variations in the speed of the strip 1. The input voltage to each of the controllers 6*a*, 6*b*, 6*c* and 6*d* from the corresponding distributor is 1/n times the output of the PI controller 9 so that each controller 6*a*, 6*b*, 6*c* and 6*d* operates each thyristor power control circuit 5*a*, 5*b*, 5*c* and 5*d* to maintain the plating current in each cell directly proportional to the line speed.

Although the conventional plating control apparatus can maintain a total current through the plating cells which varies in accordance with line speed, there still exists deficiencies in the plating caused by line speed variations, such as a deficiency in the gloss of the plated surface, a deficiency in that variations in plating thickness resulting from a variation in electrode efficiency at different line speeds, and a deficiency in anti-corrosive characteristics of the plating. It has been proposed that these deficiencies can be reduced by maintaining a plating current density within a predetermined range. The prior art plating control apparatus cannot maintain a plating current density in the predetermined range while simultaneously controlling the total plating current in accordance with variations in the line speed.

SUMMARY OF THE INVENTION

The present invention is summarized in a plating current automatic compensating apparatus wherein plating cells are energized and deenergized to maintain plating current density within a predetermined range. More particularly the number of plating cells energized in a series multiple cell plating line is changed in accordance with a function of the speed of the line so as to maintain plating current density within a desired range.

An object of the invention is to provide an automatic plating current control apparatus which maintains plating current density within a desired optimum range.

One advantage of the invention is that practical manufacture of plated strips with improved uniformity, gloss and anti-corrosive properties is made possible.

Other objects, advantages and features of the invention will be apparent from the following description of the preferred embodiment taken in conjunction with the accompanying drawings.

DESCRIPTION OF THE PREFERRED EMBODIMENTS

Figure 1:
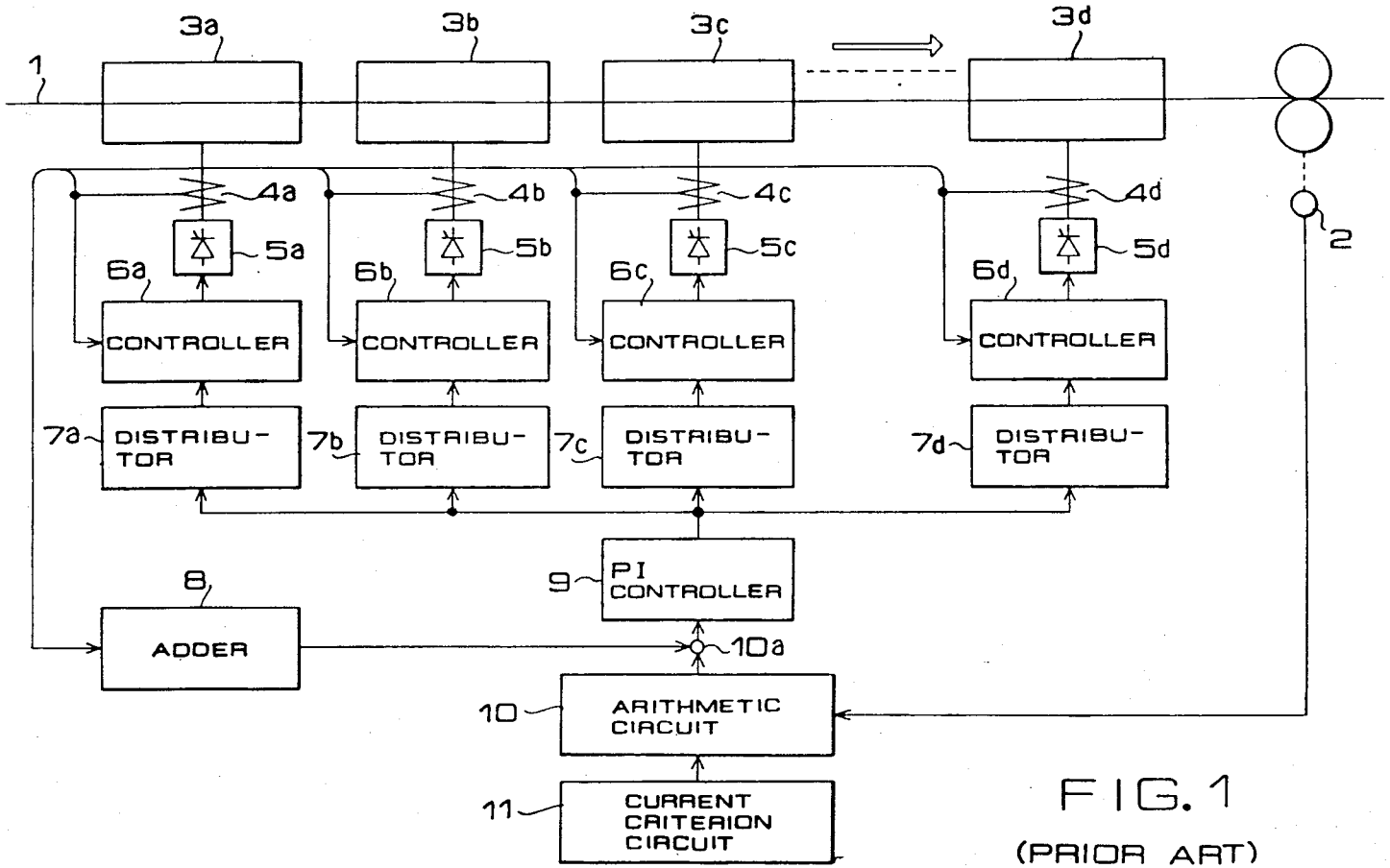
FIG. 1 (PRIOR ART)
FIG. 1 is a block diagram showing a conventional plating current automatic compensating apparatus.
Figure 2:
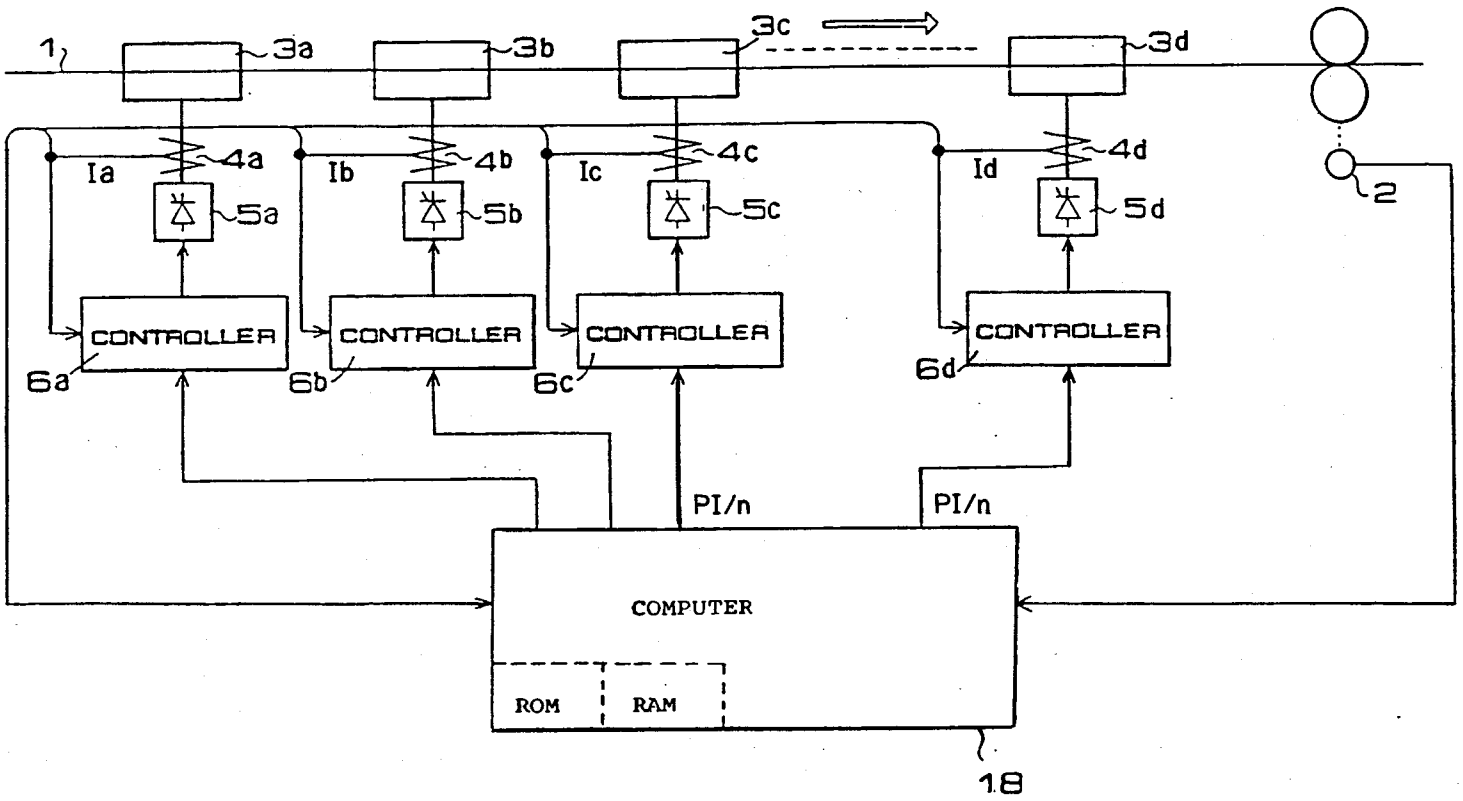
FIG. 2 is a block diagram showing a plating current compensating apparatus in accordance with the present invention.

One apparatus embodying the present invention, as shown in FIG. 2, includes a speed sensor 2, plating cells 3*a*, 3*b*, 3*c* and 3*d*, plating current sensors 4*a*, 4*b*, 4*c* and 4*d*, thyristor current control circuits 5*a*, 5*b*, 5*c* and 5*d* and controllers 6*a*, 6*b*, 6*c* and 6*d* which are substantially the same in structure and operation as similar elements described above in connection with the prior art apparatus shown in FIG. 1.

The circuit of FIG. 2 includes a computer 18 which replaces the prior art distributor circuits 7*a*, 7*b*, 7*c* and 7*d*, the adder 8, the PI controller 9, the adder 10*a*, the arithmetic circuit 10 and the current criterion circuit 11 of FIG. 1. The computer 18 has analog inputs connected to each of the current sensors 4*a*, 4*b*, 4*c* and 4*d* and to the speed sensor 2, along with analog outputs connected to inputs of each of the respective controllers 6*a*, 6*b*, 6*c* and 6*d*. Additionally, the computer 18 includes a ROM containing a program procedure, illustrated in FIGS. 4 and 5, which controls the computer 18 in a manner to provide the functions of the prior art circuit of FIG. 1 as well as to provide for maintenance of the plating current density within a predetermined range; this latter function not being possible with the prior art circuits.

Figure 3:
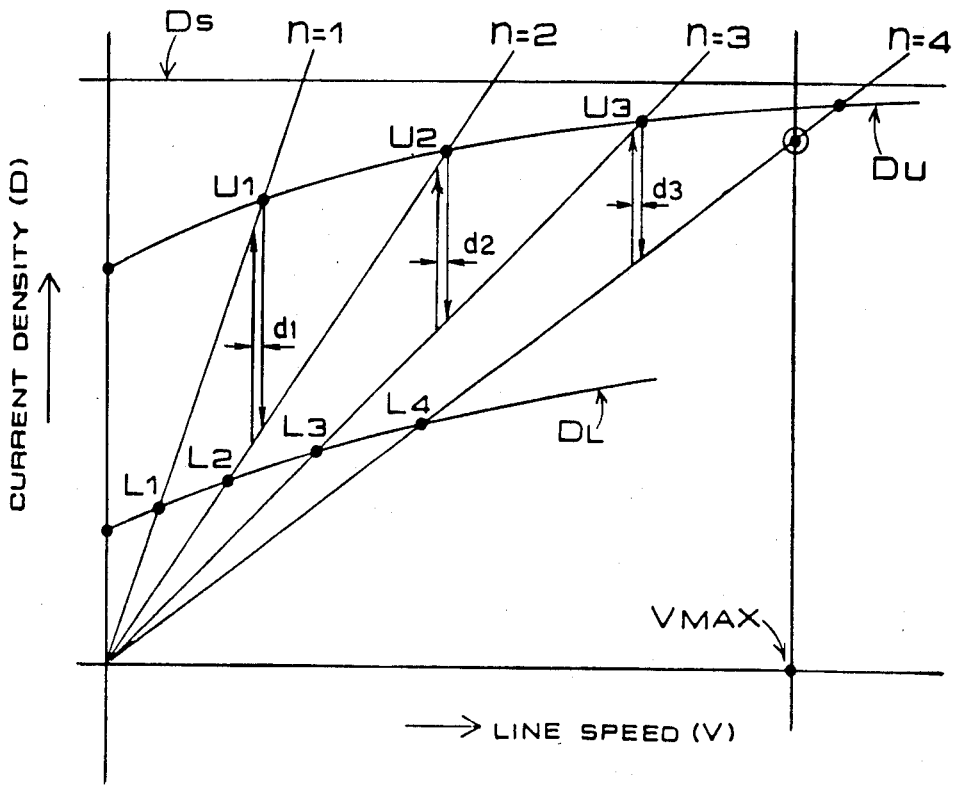
FIG. 3 is a graph showing current density vs. line speed with 1, 2, 3 and 4 cells energized in the apparatus of FIG. 2.
Figure 4:
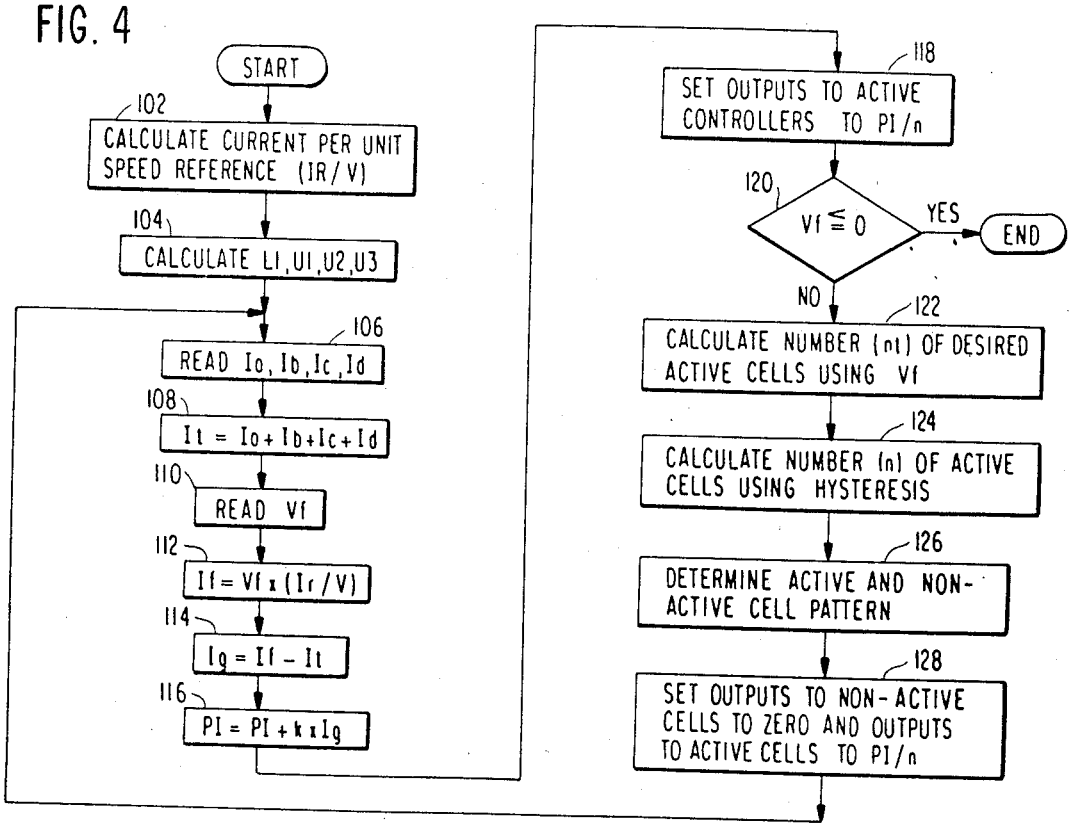
FIG. 4 is a step diagram of a procedure employed in the computer of the apparatus of FIG. 2.
Figure 5:
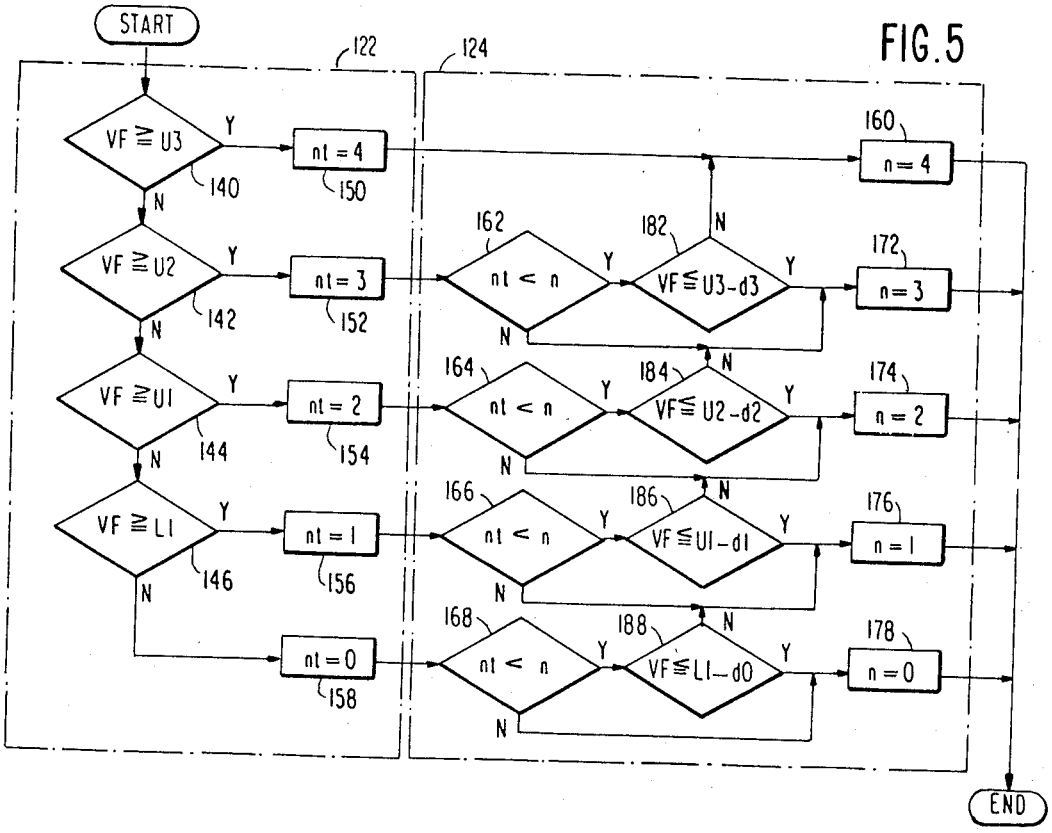
FIG. 5 is a detailed step diagram of one step shown in FIG. 4.

As shown in FIG. 4, the procedure begins with step 102 wherein a value for current per unit speed reference (IR/V) is calculated. This current per unit speed reference is the digital equivalent of the analog output produced by the current criterion circuit 11 of the prior art in FIG. 1, and is based upon the same factors such as the desired plating thickness, electrode efficiency, and the width of the strip to be plated. From step 102 the program proceeds to step 104 where speed values L1, U1, U2 and U3 are calculated. These line speed values are shown in the graph of FIG. 3 wherein line DU represents the upper limit of the permissible current density range while line DL represents the lower limit of the permissible current density range. The values DU and DL are empirical values which have been previously determined and stored for the particular base material and plating solution. Line n=1 represents the current density required to produce the desired thickness of plating relative to line speed when one plating cell is activated. Lines n=2, n=3 and n=4 represent similar current densities relative to speed for 2, 3 and 4, respectively, cells being activated. The values determining lines n=1, n=2, n=3 and n=4 are calculated based upon the desired plating thickness, plating efficiency for the particular plating solution and base material, and the length of the strip within each plating cell. From the values calculated for n=1, n=2, n=3 and n=4 and the previously determined values for DU and DL, the computer then calculates L1, U1, U2 and U3. L1 represents the line speed at which current density will be at the lower limit DL for one cell being active and thus represents the minimum line speed at which plating can occur with current density in the range from DL to DU. U1 is the line speed at which current density is at the maximum DU for one cell being active. Similarly, U2 and U3 represent line speeds for the upper current density limit for two and three cells being active, respectively.

In the next step 106, the computer reads the current values Ia, Ib, Ic and Id from each of the current sensors 4*a*, 4*b*, 4*c* and 4*d*, and then in step 108, the computer calculates the sum It of these current readings, Ia +Ib +Ic +Id, which is the total measured plating current. The output Vf of the line speed sensor 2 is read in step 110. The desired total current If is calculated in step 112 by multiplying the reading Vf obtained in step 110 by the calculated current per unit speed reference (IR/V) calculated in step 102. In step 114, the total measured plating current It, determined in step 108, is subtracted from the desired plating current If, calculated in step 112, to obtain a difference Ig. In step 116 a value PI is adjusted by multiplying Ig times a fractional constant K and adding the result to PI. The fractional value K is selected to avoid oscillations and unstable control of the plating current while permitting relatively rapid adjustment of the plating current to render It=If. In step 118 the analog outputs from computer 18 to active controllers of the controllers 6*a*, 6*b*, 6*c* and 6*d* are set in accordance with a proportional amount of the total value PI such as PI/n where n is the number of active controllers. In step 120 the procedure will stop if the speed reading from step 110 indicates that the line is stopped.

The steps 106, 108, 110, 112, 114, 116 and 118 control operation of the plating current line in accordance with one of the lines n=1, n=2, n=3 or n=4 in FIG. 3. For example if the plating current line contains four active plating cells, then the steps 106 through 118 will operate the plating cells to produce current density corresponding to n=4 for varying line speed. It is seen that the point L4 marks the minimum line speed which must be maintained in order for the current density to be above the lower limit DL of the desired range of plating current densities. During line starting and stopping periods, and sometimes during normal operation, a minimum speed L4 cannot be maintained thus resulting in inferior plating.

Steps 122, 124, 126 and 128 of FIG. 4 provide for the activation and deactivation of plating cells together with corresponding adjustment in the outputs to the controllers 6a, 6b, 6c and 6d in order to maintain current density within the range between the upper current density limit DU and the lower limit density DL. More particularly, in step 122 the line speed determined in step 110 is used to calculate the number nt of desired active cells. A procedure for performing the step 122 is illustrated in more detail in FIG. 5 and includes successive steps 140, 142, 144 and 146 where the measured speed value Vf is compared with U3, U2, U1 and L1, respectively. If the line speed is equal to or greater than U3 in step 140, the program branches to step 150 where nt is set to 4; if the line speed is greater or equal to U2 in step 142, the program branches to step 152 where nt is set to 3; if line speed is greater or equal to U1 in step 144, the program branches to step 154 where nt is set to 2; if line speed is greater or equal to L1 in step 146, the program branches to step 156 where nt is set to 1; and if the line speed is less than L1 the program proceeds from step 146 to step 158 wherein nt is set to 0.

From step 122, the program proceeds to step 124 where the number n of active cells is calculated using hysteresis. The step 124 is also illustrated in more detail in FIG. 5. From steps 150, 152, 154, 156 and 158 of the procedure 122, the program proceeds to the respective steps 160, 162, 164, 166 and 168 of the procedure 124. In step 160 where the line speed is equal to or greater than U3, the number of active cells n will be set to 4. Steps 162, 164, 166 and 168 determine if the number of cells is to be decreased, and if found false indicating either an increase or a non-change in the number of active cells, the program proceeds to respective steps 172, 174, 176 and 178 where the active cell number n is set to 3, 2, 1 and 0, respectively. If steps 162, 164, 166 and 168 are found true, the program proceeds to respective steps 182, 184, 186 and 188, respectively, where it is determined if the measured line speed is less than or equal to U3−δ3, U2−δ2, U1−δ1, and L1−δ0, respectively. δ3, δ2, δ1 and δ0 are hysteresis values selected to avoid oscillation and unstable operation from normal variations in parameter readings and calculations causing oscillation or repeated switching between the number of active cells. If steps 182, 184, 186 and 188 are false the program proceeds to the respective steps 160, 172, 174 and 176 setting the values of n=4, 3, 2, and 1, respectively; and if steps 182, 184, 186 and 188 are found true, the program proceeds to the respective steps 172, 174, 176 and 178 where the number of active cells n is set to 3, 2, 1 and 0, respectively.

The selection of the number of active cells n using hysteresis is illustrated also in the graph of FIG. 3 where a decrease in the number of active cells from n=2, 3 or 4 to n=1, 2 or 3, respectively, occurs only when the line speed is reduced to U1−δ1, U2−δ2 and U3 −δ3, respectively. For example, if one cell is active and the line speed increases from L1 to U1, the program will set nt=2 in step 154 and then proceed to step 164 and step 174 making n=2. The speed readings, and the calculations associated therewith vary and thus the next time that the computer passes through steps 122 and 124, the actual speed reading may be slightly less than U1 due to this normal variation. In this case the program will proceed from step 144 to 146 and 156 setting nt=1. Then in step 166 it is found that nt is less than n indicating that this is a decrease in the number of active cells causing the program to proceed to step 186. In step 186 the normal variation in speed readings and associated calculations will be less than the value δ1 to indicate a false condition causing the program to branch to step 174 maintaining the value of n at 2 to avoid switching between n=1 and n=2 due to the normal variation in speed readings and associated calculations. The steps 182, 184 and 188 with their associated hysteresis factors δ3, δ2 and δ0 provide for similar avoidance of switching between n=3 and 4, n=3 and 2 and n=1 and 0.

From step 124 in FIG. 4 the program proceeds to step 126 where the particular active and non-active cell pattern is determined. For example as shown in FIG. 2 the pattern of cell activation is opposite to the line feed direction; i.e., the line feed is from left to right while cells are activated beginning with the rightmost inactive cell and proceeding with the next left cell, or from right to left. Deactivation of cells is in the same direction as the line feed; i.e., cells are deactivated beginning with the left most active cell and preceding to the next cell on the right. Many other cell activation and deactivation patterns are possible such as activating cells in the direction of line movement and deactivating cells in the direction opposite line movement, or activation and deactivation of cells may be according to predetermined patterns where intermediate cells are activated and/or deactivated prior to activation or deactivation of end cells. After determining the pattern of active and nonactive cells from stored patterns or programmed procedures, the program in step 128 then proceeds to set computer outputs to controllers of the nonactive cells at 0 to thus deactivate such cells, and sets computer outputs to controllers of the active cells to PI/n which is a new distribution value calculated with the new value of n. From step 128 the program returns to step 106 to begin another cycle through steps 106–128.

When the number of active cells of the embodiment of FIG. 2 is increased from n to n+1 the current density is decreased as shown at 200 in FIG. 7(*a*) by setting the current flow to each of the cells n+1 to PI/(n+1). A reduction in the amount of plating material deposited on the section of the strip within the cells n+1 occurs as shown in FIG. 7(*e*). A point on the strip 1 at the border between the most recently added cell and its adjoining active cell, as represented by line 202 in FIG. 7(*e*), will now pass through n cells but will have plating applied at the rate 1/(n+1) thus causing the strip 1 at this point 202 to have a plating thickness reduced by 1/(n+1) of the total desired thickness. FIG. 7(*f*) illustrates an increase in the amount of plating material which occurs when a cell is deactivated in accordance with FIG. 7(*d*) resulting in an increase in the plating current density as shown at 204 in FIG. 7(*b*). At the point 206 on the strip 1 between the deactivated cell and its adjacent remaining activated cell the strip 1 will have already had a thickness plated thereon at the rate of 1/(n+1) and will then traverse through n cells and be plated at the rate of 1/n so that this point 206, the line will have an extra thickness equal to 1/(n+1) of the total desired thickness thereon. In the plating of some products such deviations in the amount of plated material as illustrated in FIGS. 7(*e*) and 7(*f*) is undesirable and would thus render the section of strip 1 within the plating cells of FIG. 2 unsuitable.

Figure 6:
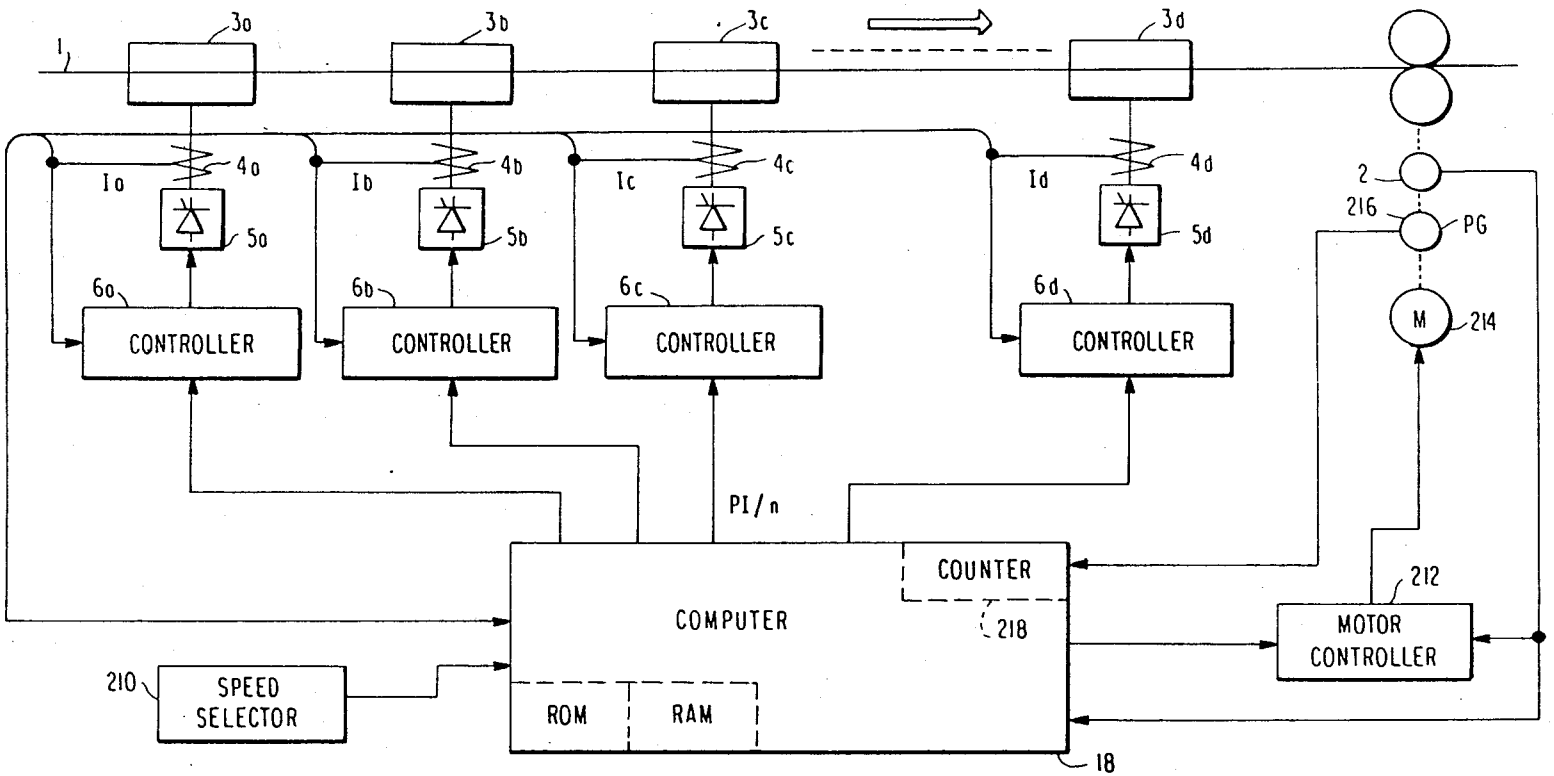
FIG. 6 is a block diagram of another plating current compensating apparatus in accordance with the present invention.
Figure 7D:
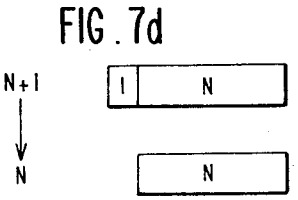
FIG. 7*d* is a diagram illustrating the deenergization of a plating cell in the apparatus of FIG. 6.
Figure 7F:
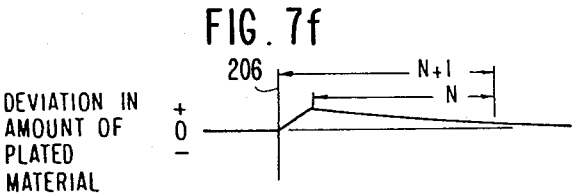
FIG. 7*f* is a graph of an increase in plating thickness caused by the deenergization of a plating cell on a section of material within the plating cells of FIG. 2 at the time of deenergization.
Figure 7B:
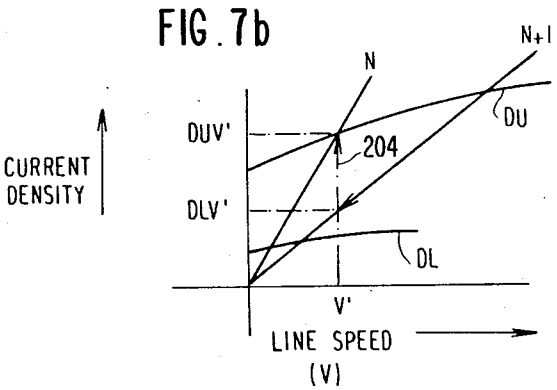
FIG. 7*b* is a graph similar to that of FIG. 7*a*, but illustrating deenergization of a plating cell.
Figure 7C:
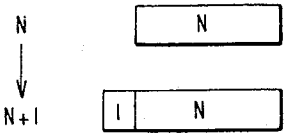
FIG. 7*c* is a diagram illustrating the energization of an additional plating cell in the apparatus of FIG. 6.
Figure 7E:
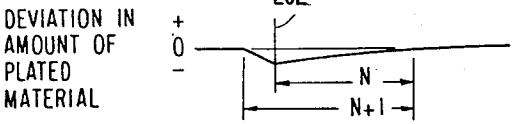
FIG. 7*e* is a graph of a decrease in plating thickness caused by the energization of an additional plating cell on a section of material within the plating cells of FIG. 2 during the energization.
Figure 7A:
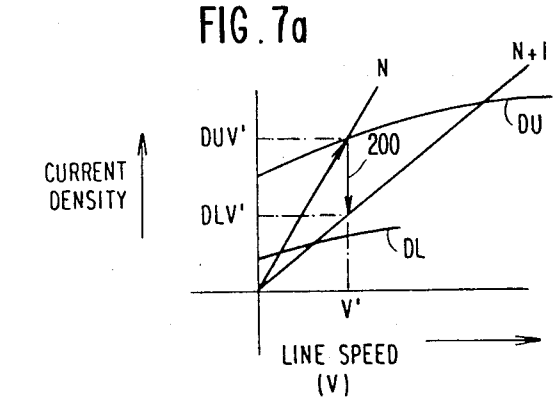
FIG. 7*a* is a graph showing current density versus line speed during the energization of a plating cell in the apparatus of FIG. 6.

A modified plating control circuit is illustrated in FIG. 6 for substantially reducing the deviation in the amount of plated material illustrated by FIGS. 7(*e*) and 7(*f*). The computer 18' in FIG. 6 includes an input from a speed selector 210 which may be either an analog device such as a potentiometer or a digital switch device from which the computer can determine the desired line speed set by an operator. The computer 18 also includes an analog output to a motor controller 212 which receives feedback from the tachometer in order to operate motor 214 driving the strip 1 in accordance with analog signal from the computer 18. Additionally the computer 18 includes a counter 218 which s operated by pulses from a pulse generator 216 connected to the drive for the strip 1 to produce pulses having a frequency proportional to line speed.

Figure 8:
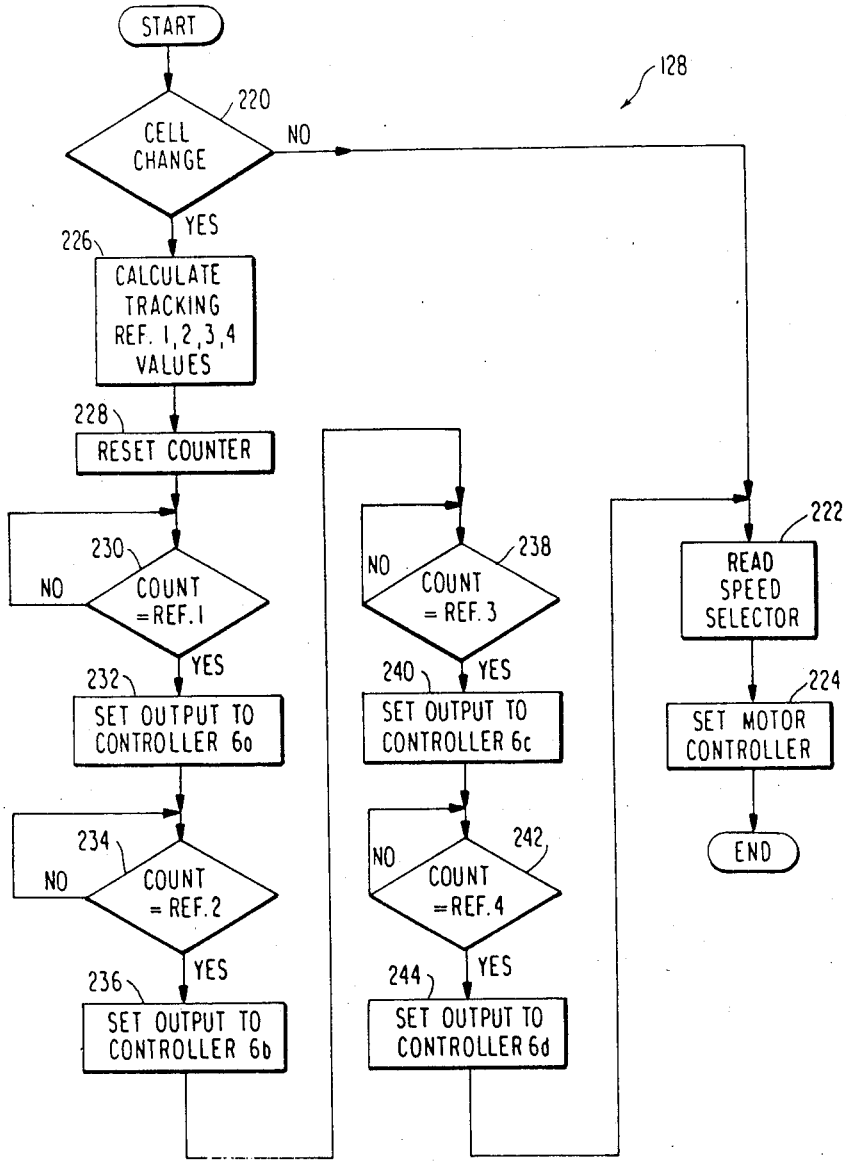
FIG. 8 is a step diagram of a computer program modification employed in the apparatus of FIG. 6.

The computer program in computer 18' is modified from that of FIG. 4 by a procedure indicated generally at 128' in FIG. 8 which replaces step 128 in FIG. 4. At the beginning of this procedure the need for a cell change is determined in step 220. If false, i.e., no cell is to be newly energized or deenergized, the program branches to step 222 where the line speed selector 210 is read, and then to step 224 where the motor controller 212 is set in accordance with the reading mode in step 222. From step 224 the program will return to step a06 in FIG. 4.

If step 220 is true the program proceeds to step 226 where tracking reference values for the controllers 6*a*, 6*b*, 6*c* and 6*d* are calculated. These values include counts of the counter 218 corresponding to advancement of a selected imaginary point on the strip from a selected position in front of or at the first active cell to selected positions at each respective cell, along with values to which the respective controllers are to be set. In the next step 228 the counter 218 is reset to 0. In step 230, the count of the counter 218 is compared with the first reference count in step 230 and continues to cycle through step 230 until true where upon the program proceeds to step 232 where the output to controller 6*a* is set in accordance with the corresponding value calculated in step 226. Steps 234 and 236 similarly set the controller 6*b* when the count in counter 218 equals the second reference count, steps 238 and 240 set the controller 6*c* when the count in the counter 218 equals the third reference value, and steps 242 and 244 set the controller 6*d* when the count in the counter 218 corresponds to the reference 4 count. After step 242 the program proceeds to step 222.

In the calculation of the tracking reference 1, 2, 3 and 4 values in step 226, counts are determined so that changes in the current values in the plating cells 3*a*, 3*b*, 3*c* and 3*d* will be made when a tracking point, i.e., an imaginary point, on the strip 1 reaches a particular point relative to each of the cells. For example, assuming that cell 3*a* is to be energized, then the reference count 1 corresponds to the tracking point on the strip 1 at the entrance of cell 3*a*, and the value applied by computer 18' to the controller 6*a* is changed from zero to PI/(n+1) where n is the total number of energized cells prior to energization of cell 3*a*. Reference count 2 corresponds to the count when this tracking point reaches the beginning or entrance of cell 3*b* and the corresponding value for controller 6*b*will likewise be PI/(n+1). Similarly, reference counts 3 and 4 correspond to the counts when the imaginary or tracking point of the strip 1 reaches the entrance to cells 3*c* and 3*d* and the values to be supplied to the controllers 6*c* and 6*d* are to PI/(n+1).

If the number of energized plating cells is to be decreased from n+1 to n by deenergized plating cell 3*a*, then the value to be applied to controller 6*a* is 0 to effectively deenergize plating cell 3*a* at the reference count 1. The new values to be sent to controllers 6*b*, 6*c* and 6*d* will be PI/n to increase the plating currents of cells 3*b*, 3*c* and 3*d* when the count of counter 218 equals reference counts 2, 3 and 4, respectively. Also reference counts 2, 3 and 4 can alternatively be set to correspond when the tracking point reaches the exit points of cells 3*b*, 3*c* and 3*d* instead of the entrance points.

By performing the change in current for each successive cell when the tracking point reaches the entrance of each cell, the deviation in thicknes of plating occurring in advance of points 202 and 206, i.e., to the right of points 202 and 206 in FIGS. 7(*e*) and 7(*f*), is eliminated. There will still be some deviation in plating thickness occurring on the left of points 202 and 206 which is not eliminated. However, the elimination of the plating deviation to the right of points 202 and 206 greatly reduces the amount of unsuitably plated material.

When the increase of current is delayed until the tracking point reaches the exit points for cells following a cell being deenergized to decrease the number of active cells, the increase in plated thickness occurring to the section of step 1 to the left of point 206 in FIG. 7(*f*) is eliminated, and instead a short section of strip 1 to the right of point 206 will have a decreased plating thickness. This eliminates undesirable use of plating material on an unsuitably plated section of the strip 1.

It is noted that tracking of the imaginary point through the plating cells need only begin at the cell being changed and then proceed through any following cell; thus preceding cells which are deenergized and will remain deenergized after tracking is completed may have 0 or low reference counts to avoid the delay in tracking the imaginary point through these non-energized cells. Additionally, it is noted that, during the procedure 128' of FIG. 8, changes in line speed and changes in the value PI, i.e., steps 106, 108, 110, 112, 114 and 116 in FIG. 4, are inhibited since the program must complete the tracking through steps 230, 232, 234, 236, 238, 240, 242 and 244 prior to being able to adjust the value PI or change the line speed. Upon completion of the tracking steps the program proceeds to steps 222 and 224 where normal line speed changes are made, and then to steps 106, 108, 110, 112, 114 and 116 where normal adjustment of the value PI occurs.

Figure 9:
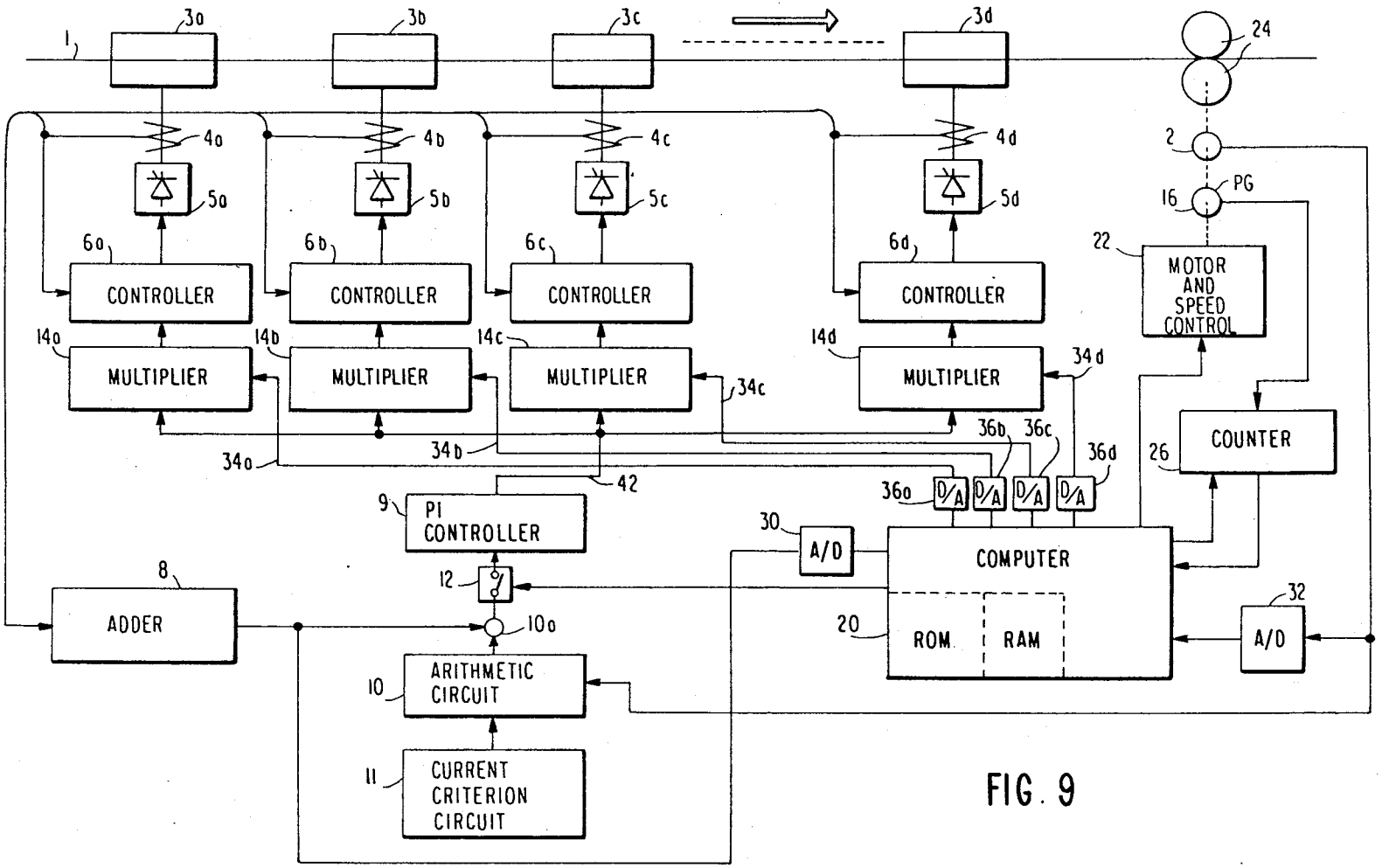
FIG. 9 is a block diagram of a further variation of a plating current compensating apparatus in accordance with the present invention.

A further variation of the apparatus embodying the present invention, as shown in FIG. 9, includes a speed sensor 2, plating cells 3*a*, 3*b*, 3*c* and 3*d*, plating current sensors 4*a*, 4*b*, 4*c* and 4*d*, controlled rectifier circuits 5*a*, 5*b*, 5*c* and 5*d*, controllers 6*a*, 6*b*, 6*c* and 6*d*, adder 8, PI controller 9, adder 10*a*, arithmetic circuit 10, and current criterion circuit 11 which are substantially the same in structure and operation as similar elements described above in connection with the prior art apparatus shown in FIG. 1. The distributors 7*a*, 7*b*, 7*c* and 7*d* of the prior art FIG. 1 are replaced by respective multipliers 14*a*, 14*b*, 14*c* and 14*d* in FIG. 2.

The circuit of FIG. 2 additionally includes a computer 20 which operates a motor and speed control 22 driving rolls 24 to advance the strip 1 through the plating cells 3*a*, 3*b*, 3*c* and 3*d*. A pulse generator 16 driven at the same rate as the rolls 24 has an output connected to the input of a counter 26 which has its outputs connected to input ports of the computer 20. The computer 20 has an output connected to a reset input of the counter 26. Additional digital inputs to the computer 20 are provided by analog to digital converters 30 and 32 which receive analog signals indicating the magnitude of the total plating current to the cells 3a–3d and the line speed, respectively. One output of the computer 20 operates a switch 12 interposed between the adder 10a and the PI controller 9 for disconnecting the PI controller 9 from the adder 10a so that the output of PI controller can be locked and prevented from changing due to a signal from adder 10a.

Outputs 34a, 34b, 34c and 34d from respective digital to analog converts 36a, 36b, 36c and 36d operated by the computer 20 are connected to inputs of the multiplier circuits 14a, 14b, 14c and 14d which multiply the signal on line 42 from PI controller 9 by the signal on the corresponding line 34a, 34b, 34c and 34d. The multipliers 14a, 14b, 14c and 14d produce outputs which operate the respective controllers 6a, 6b, 6c and 6d. When the output of one or more multipliers is zero, the corresponding controller deenergizes its plating cell by discontinuing the production of pulses necessary to operate the silicon controlled rectifier circuit. For magnitudes of signals on the outputs of the multipliers greater than zero, the controllers produce pulses which have suitable phases relative to the AC power source for generating the corresponding magnitudes of currents in the plating cells.

Figure 10:
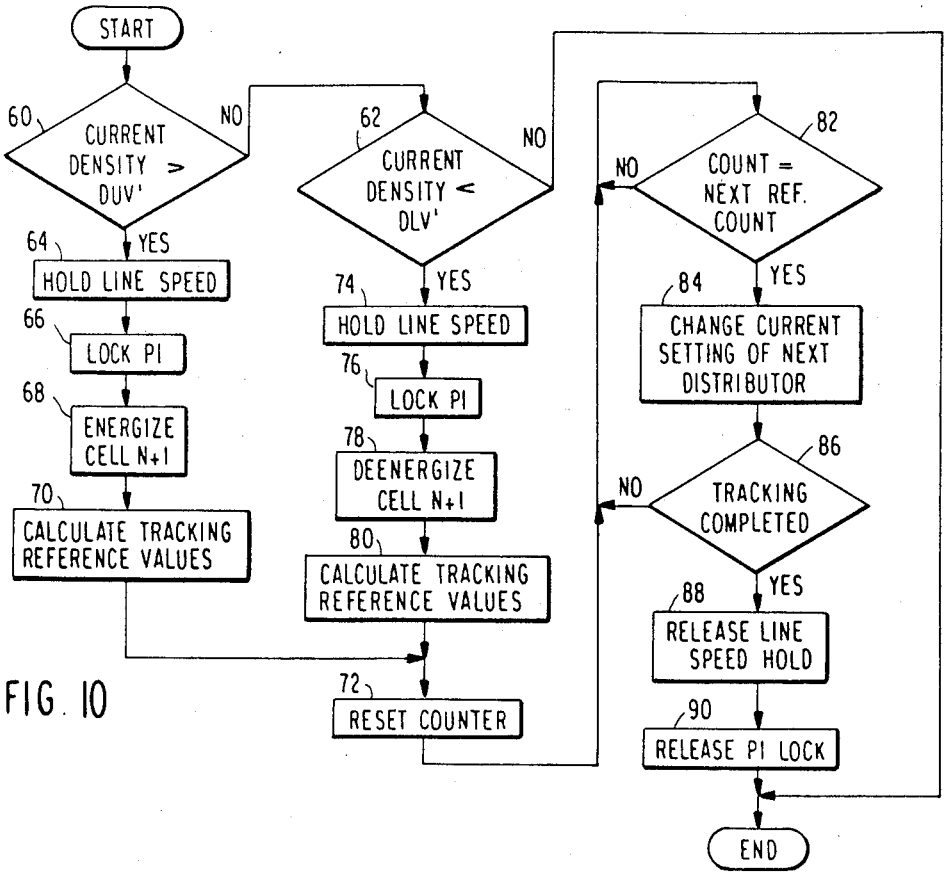
FIG. 10 is a step diagram of a program procedure employed in a computer in the apparatus of FIG. 9.

The apparatus of FIG. 9 substantially reduces the deviation in thickness of plated material, FIGS. 7(*e*) and 7(*f*), which can occur on the section of the strip 1 within the plating cells at the time of the increase or decrease in active cells by means of the program procedure of FIG. 10 for operating the computer 20 during the increase or decrease in active cells. The procedure of FIG. 10 is included in a continuously cycling main program, or called thereby, wherein the main program includes other conventional procedures such as operation of the motor and speed control 22, etc. In a first step 60, the total plating current of the cells from analog to digital converter 30 is read and the current density is computed from this reading and the number of active plating cells. The current density is then compared with the value DUV' and if less than the maximum permissible value, proceeds to step 62 where this current density is compared with the minimum value DLV'. If the current density is greater than this minimum value DLV' then the program exits the procedure of FIG. 10 without making any change in the number of active plating cells.

If the current density is found greater than DUV' in step 60, the program proceeds to step 64 where any necessary steps are taken to prevent change in the line speed. From step 64 the program proceeds to step 66 where the computer 20 opens switch 12 to lock the output of the PI controller 9 at its level before energization of an additional plating cell. Then in step 68 the additional plating cell, such as cell 3a is energized. Energization is performed by changing the value on line 34ato the multiplier 14a from zero to a value calculated to generate a signal on the output of multiplier 14a corresponding to $1/(n+1)$ of the total current read from analog to digital converter 30 in step 60. Next in step 70 the computer calculates the number of cells and the counts of the counter 26 required for a selected imaginary point on the strip 1 to advance to the entrance of each of the succeeding cells 3b, 3c, 3d from the entrance of cell 3(*a*). Then the program proceeds to step 72 where the counter 26 is reset to 0.

If the current density is found less than the lower limit in step 62, the program proceeds through steps 74, 76, 78 and 80 wherein steps 74 and 76 are the same as steps 64 and 66. In step 78 however, a cell, such as cell 3a, is deenergized by applying the value zero on line 34a to the multiplier 14a which will generate a disabling or 0 output to the controller 6a. Thus, no plating current will pass through cell 3a. In step 80 count values and the number of plating cells are calculated. These count values differ from the count values selected in step 70 in that the count values correspond to counts required for the imaginary point, to advance to exits of the corresponding cells 3b, 3c and 3d from the entrance of cell 3a. Then the program proceeds to step 72 where the counter 26 is reset.

From step 72 the program proceeds to step 82 where the count in the counter 26 is read and compared with the first count value calculated in step 70 or 80. Step 82 is repeated until the count value equals the reference count. Then the program proceeds to step 84 where the setting of the multiplier 14b will be adjusted by changing the signal value on line 34b. This value will have been calculated in step 70 or 80. A signal value calculated in step 70 generates a volatage on line 34b which causes a change in the output of multiplier 14b causing the controller 6b to decrease the plating current flow to cell 3b by $1/(n+1)$, where a signal value calculated in step 80 causes the signal on line 34b to generate a voltage to increase the output of multiplier 14b to cause controller 6b to increase the plating current to cell 3b by $1/(n+1)$. Additionally, in step 84, an index value will be incremented to point to the next multiplier, e.g., 14c. Then in step 86 the program returns to step 82 if tracking of the imaginary point has not been completed to all of the plating cells. Steps 82 and 84 are then repeated for cells 3c and 3d so that when the imaginary point on the line 1 reaches the entrance, in case of an increase in the number of plating cells, or reaches the exit in case of a decrease in the number of plating cells, the current of the corresponding cell is changed. When the imaginary tracking point passes the exit of the last cell, step 86 indicates that the tracking is completed and the computer proceeds to step 88 where the hold on any speed change is released. In step 90 the switch 12 is closed which permits the PI controller 9 to control the overall current through the active cells in a conventional manner.

Since many variations, modifications and changes in detail may be made to the above described embodiments, it is intended that all matter described above and shown in the drawings be interpreted as illustrative of the invention and not as limiting on the scope and spirit of the invention as defined in the following claims.

What is claimed is:

1. An apparatus for automatically controlling a plurality of plating cells in response to speed changes of an elongated material passing sequentially through the plating cells so as to maintain plating current density within a predetermined range while forming a desired plating thickness on the elongated material, the apparatus comprising means for measuring the speed of the elongated material passing through the plating cells, means connected to the speed measuring means for determining (1) a desired total plating current required to produce the desired plating thickness at the measured speed, and (2) a number of plating cells required to be energized to maintain the plating current density within the predetermined range at the measured speed, a plurality of current measuring means for measuring the plating currents to the respective plating cells, summing means connected to the plurality of current measuring means for obtaining the sum of the plating currents to the cells, a plurality of controllers connected to the respective plating cells and having inputs for controlling the plating currents to the cells in response to signals applied to the inputs of the, controllers, and means responsive to the determining means and the summing means for generating and applying signals to the inputs of the controllers so as to energize the determined number of plating cells with the remaining number of cells being deenergized and to distribute the total required plating current among the energized plating cells to maintain the plating current density within the predetermined range while producing the desired plating thickness on the elongated material.

2. An apparatus as claimed in claim 1 wherein the determining means includes means for increasing the required number of plating cells upon increases in the measured speed to first predetermined speeds, and means for decreasing the required number of plating cells upon decreases in the measured speed to second predetermined speeds, said second predetermined speeds being less than the first predetermined speeds by a hysteresis value which is greater than normal variations in speed measuring operations.

* * * * *

UNITED STATES PATENT AND TRADEMARK OFFICE

CERTIFICATE OF CORRECTION

PATENT NO. : 4,765,878

DATED : August 23, 1988

INVENTOR(S) : Katsumi Nagano et al.

It is certified that error appears in the above-identified patent and that said Letters Patent is hereby corrected as shown below:

Cover page, insert the following:

-- [30] Foreign Application Priority Data
Dec. 16, 1983 [JP] Japan ..... 58-237714 --.

Column 7, line 10, after "tachometer" insert the numeral --2--;

line 13, "s" should be --is--;

line 27, "a06" should be --106--.

Column 8, line 16, "thicknes" should be --thickness--.

Column 10, line 26, "volatage" should be --voltage--.

Signed and Sealed this

Eighth Day of August, 1989

*Attest:*

*Attesting Officer*

DONALD J. QUIGG

*Commissioner of Patents and Trademarks*